US007540220B2

(12) United States Patent
Shiao

(10) Patent No.: US 7,540,220 B2
(45) Date of Patent: Jun. 2, 2009

(54) ELECTRONIC TORQUE WRENCH HAVING A TRIP UNIT

(76) Inventor: Hsuan-Sen Shiao, No. 55, Cheng-Feng Lane, Tai-Ming Rd., Wu-Jih Hsiang, Taichung Hsien (TW)

( * ) Notice: Subject to any disclaimer, the term of this patent is extended or adjusted under 35 U.S.C. 154(b) by 54 days.

(21) Appl. No.: 11/924,593

(22) Filed: Oct. 25, 2007

(65) Prior Publication Data

US 2009/0107306 A1 Apr. 30, 2009

(51) Int. Cl.
*B25B 23/142* (2006.01)
*B25B 23/159* (2006.01)

(52) U.S. Cl. ..... 81/478; 81/483

(58) Field of Classification Search ..... 81/467, 81/469–470, 478–479, 483, 480–481; 73/862.23
See application file for complete search history.

(56) References Cited

U.S. PATENT DOCUMENTS 4,403,532 A * 9/1983 Wallace et al. ..... 81/483
4,485,703 A 12/1984 Grabovac et al.
4,958,541 A * 9/1990 Annis et al. ..... 81/479
5,129,293 A 7/1992 Larson et al.
5,435,190 A 7/1995 Jansson et al.
5,557,994 A * 9/1996 Nakayama ..... 81/478
5,911,801 A * 6/1999 Fravalo et al. ..... 81/478
6,119,562 A * 9/2000 Jenkins ..... 81/479
6,742,418 B2 * 6/2004 Amami ..... 81/57.39
6,968,759 B2 11/2005 Becker et al.
6,981,436 B2 1/2006 Becker et al.
7,000,508 B2 * 2/2006 Li et al. ..... 81/479
7,107,884 B2 * 9/2006 Cutler et al. ..... 81/479
7,469,619 B2 * 12/2008 Anjanappa et al. ..... 81/479
2005/0072278 A1 * 4/2005 Cutler et al. ..... 81/467

* cited by examiner

*Primary Examiner*—D. S Meislin
(74) *Attorney, Agent, or Firm*—Nixon Peabody LLP

(57) ABSTRACT

An electronic torque wrench includes a tubular housing having a receiving space, a working unit having an abutment portion extending into the receiving space, a strain sensor provided in the working unit, and a trip unit disposed in the receiving space and including a cylinder having a chamber containing hydraulic fluid, a trip element disposed movably between the abutment portion and the cylinder and having a seat portion, and a control element connected to the cylinder for pressurizing or depressurizing the hydraulic fluid so as to permit the abutment portion to be seated on or to move away from a center of the seat portion. A central processor is connected electrically to the strain sensor and the control element, and controls the control element to depressurize the hydraulic fluid when an applied torque measured by the strain sensor is larger than a preset reference torque value.

9 Claims, 6 Drawing Sheets

ELECTRONIC TORQUE WRENCH HAVING A TRIP UNIT

BACKGROUND OF THE INVENTION

1. Field of the Invention

This invention relates to a wrench, more particularly to an electronic torque wrench having a trip unit.

2. Description of the Related Art

Conventional torque wrenches can be divided into mechanical types, such as those disclosed in U.S. Pat. Nos. 4,485,703, 5,129,293, and 5,435,190, and electronic types, such as those disclosed in U.S. Pat. Nos. 4,958,541, 6,981,436B2, and 6,968,759B2. Generally, a conventional mechanical torque wrench includes a tubular housing, a lever connected pivotally to the tubular housing and aligned with the same in a normal state, a ratchet drive head connected to the lever, and a compression spring for biasing the lever. When the torque applied by the wrench to a bolt is larger than a biasing force of the compression spring, the lever is displaced slantingly until it bumps against the tubular housing. As such, the user can clearly feel the trip made by the lever. However, a drawback of this kind of wrench is that it is difficult to accurately design the compression spring to provide a desired preset biasing force. Therefore, a proper biasing force cannot be provided, especially when the compression spring experiences fatigue.

A conventional electronic torque wrench generally employs a plurality of strain gauges secured to a lever to produce a variable resistance to thereby measure an applied torque. When the torque applied by the wrench exceeds a preset torque value, a processing unit of the wrench will activate a vibrating motor, an audible alarm signal, or an illuminating lamp to warn the user. Although the conventional electronic torque wrench can accurately set the preset torque value through an electronic control method, since the lever cannot be displaced so as to bump against the tubular housing, the user cannot directly and clearly feel the tripping of the lever, so that the user is likely to stop the operation too late, thereby resulting in applying excessive torque.

SUMMARY OF THE INVENTION

Therefore, the object of the present invention is to provide an electronic torque wrench that can produce an accurate and direct trip similar to that of a mechanical torque wrench.

According to this invention, an electronic torque wrench comprises a tubular housing having a receiving space, a working unit connected pivotally to the tubular housing, a strain sensor provided in the working unit, a trip unit disposed in the receiving space, and a central processor provided on the tubular housing. The working unit has a drive head extending outwardly of the tubular housing, and an abutment portion extending into the receiving space. The trip unit includes a cylinder fixed to the tubular housing and having a chamber containing hydraulic fluid, a trip element disposed movably between the abutment portion and the cylinder, and a control element connected to the cylinder. The trip element has a seat portion to seat the abutment portion, and a plunger extending into the chamber. The control element pressurizes the hydraulic fluid so as to push the plunger to thereby cause the abutment portion to be seated on a center of the seat portion of the trip element, or depressurizes the hydraulic fluid so as to permit the abutment portion to move away from the center of the seat portion. The central processor is connected electrically to the strain sensor and the control element, and controls the control element to depressurize the hydraulic fluid when an applied torque measured by the strain sensor is larger than a preset reference torque value.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
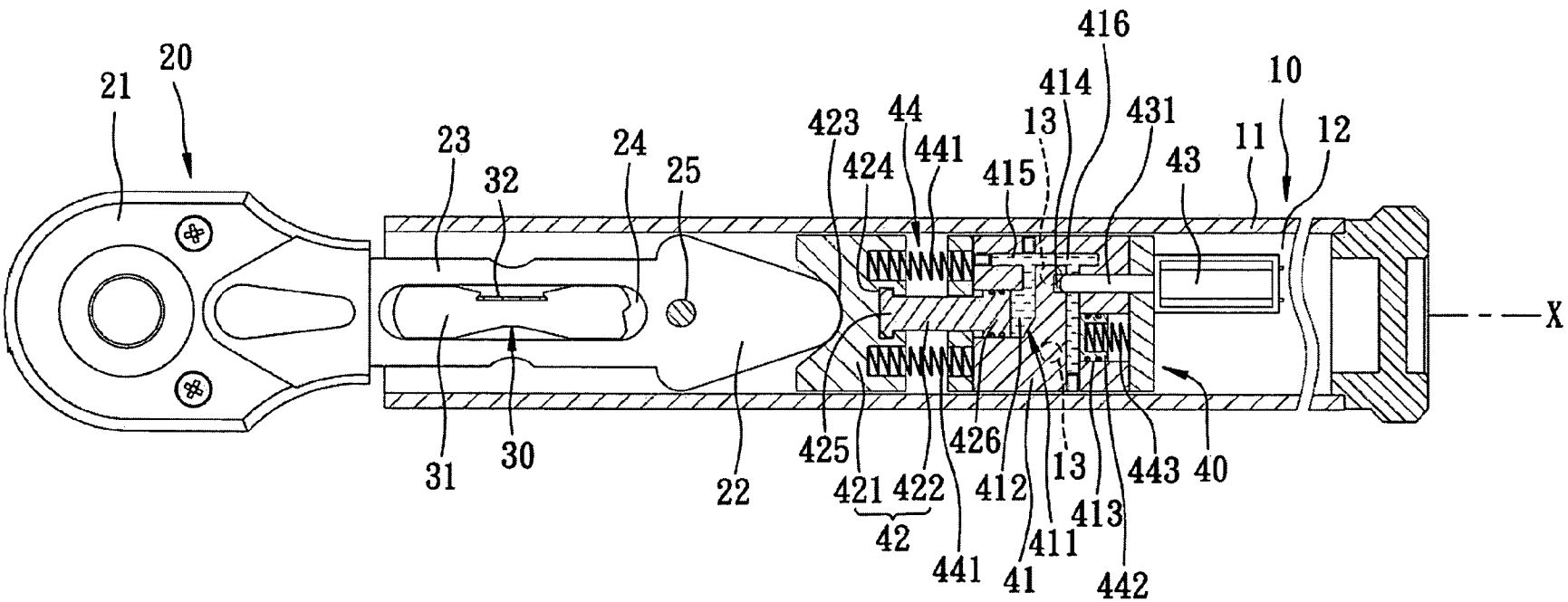
FIG. 1 is a fragmentary partly sectional view of the first preferred embodiment of an electronic torque wrench according to the present invention.

Before the present invention is described in greater detail, it should be noted that the same reference numerals have been used to denote like elements throughout the specification.

Referring to FIGS. 1 to 4, the first preferred embodiment of an electronic torque wrench according to the present invention is shown to comprise a tubular housing 10, a working unit 20, a strain sensor 30, a trip unit 40, a central processor 50, an input unit 60, a display unit 70, and a power supply 80.

The tubular housing 10 has a surrounding wall 11 defining a receiving space 12 that extends along an X-axis.

The working unit 20 is connected pivotally to the tubular housing 10, and has a drive head 21 extending outwardly of the tubular housing 10, an abutment portion 22 extending into the receiving space 12, a neck portion 23 connected between the drive head 21 and the abutment portion 22, a slot 24 formed in the neck portion 23 and extending along the X-axis, and a pivot pin 25 for connecting pivotally the working unit 20 to the surrounding wall 11 of the tubular housing 10.

The strain sensor 30 has a strain body 31 disposed in the slot 24, and a strain gauge 32 attached to the strain body 31. Alternatively, the strain sensor 30 may include a plurality of the strain gauges 32 attached to the strain body 31. The strain gauge 32 may be similar to that disclosed in U.S. Pat. Nos. 4,958,541, 6,981,436B2, and 6,968,759B2, and may be directly secured to the neck portion 23 of the working unit 20.

The trip unit 40 is disposed in the receiving space 12, and includes a cylinder 41, a trip element 42, a control element 43, and a biasing mechanism 44. The cylinder 41 is fastened to the surrounding wall 11 of the tubular housing 10 by using two bolts 13, and has a chamber 411 containing hydraulic fluid 415. In this embodiment, the chamber 411 has a first chamber section 412, a valve channel 414 connected fluidly to the first chamber section 412 through a connecting channel 416, and a second chamber section 413 connected fluidly to the valve channel 414. The valve channel 414 and the connecting channel 416 interconnect fluidly the first and second chamber sections 412, 413.

The trip element 42 is disposed movably and axially between the abutment portion 22 and the cylinder 41, and includes a seat portion 421 and a plunger 422. The seat portion 421 has a concaved contact face 423 to contact a rear end of the abutment portion 22 of the working unit 20, and an engaging groove 424 opposite to the concaved contact face 423. The rear end of the abutment portion 22 has a curvature smaller than that of the concaved contact face 423 so that the abutment portion 22 can be seated on the center of the seat portion 421. The plunger 422 has a front end portion 425 engaged to the engaging groove 424, and a rear end portion 426 extending into the first chamber section 412.

The control element 43 is connected to the cylinder 41, and has a valve rod 431 that is disposed slidably and axially in the valve channel 414 to control flow of the hydraulic fluid 415 within the chamber 411. In this embodiment, the control element 43 is a solenoid valve.

The biasing mechanism 44 is provided for biasing the trip element 42 toward the abutment portion 22, and has two spaced-apart first spring members 441 disposed between the seat portion 421 of the trip element 42 and the cylinder 41.

The trip unit 40 further includes a piston 442 disposed movably and axially in the second chamber section 413, and a second spring member 443 disposed between the piston 442 and a rear wall of the cylinder 41 to bias the piston 442 so as to force the hydraulic fluid 415 from the second chamber section 413 to the valve channel 414.

The central processor 50 is disposed within the receiving space 12, and is connected electrically to the strain gauge 32 and the control element 43. In this embodiment, the central processor 50 has a conventional circuit board, and may utilize a conventional layout of conventional circuit components, such as a Wheatstone bridge, an amplifier, a recorder, a microprocessor, etc. Hence, the central processor 50 is not detailed herein.

The input unit 60 and the display unit 70 are provided on the tubular housing 10, and are connected electrically to the central processor 50. A user can enter a preset reference torque value of desired maximum torque into the central processor 50 through the input unit 60, and the preset reference torque value is shown on the display unit 70. Since the input unit 60 and the display unit 70 are known in the art, a detailed description of the same is dispensed herewith for the sake of brevity.

The power supply 80 is disposed in the receiving space 12, and is connected electrically to the control element 43 and the central processor 50. In this embodiment, the power supply 80 is a battery.

Figure 2:
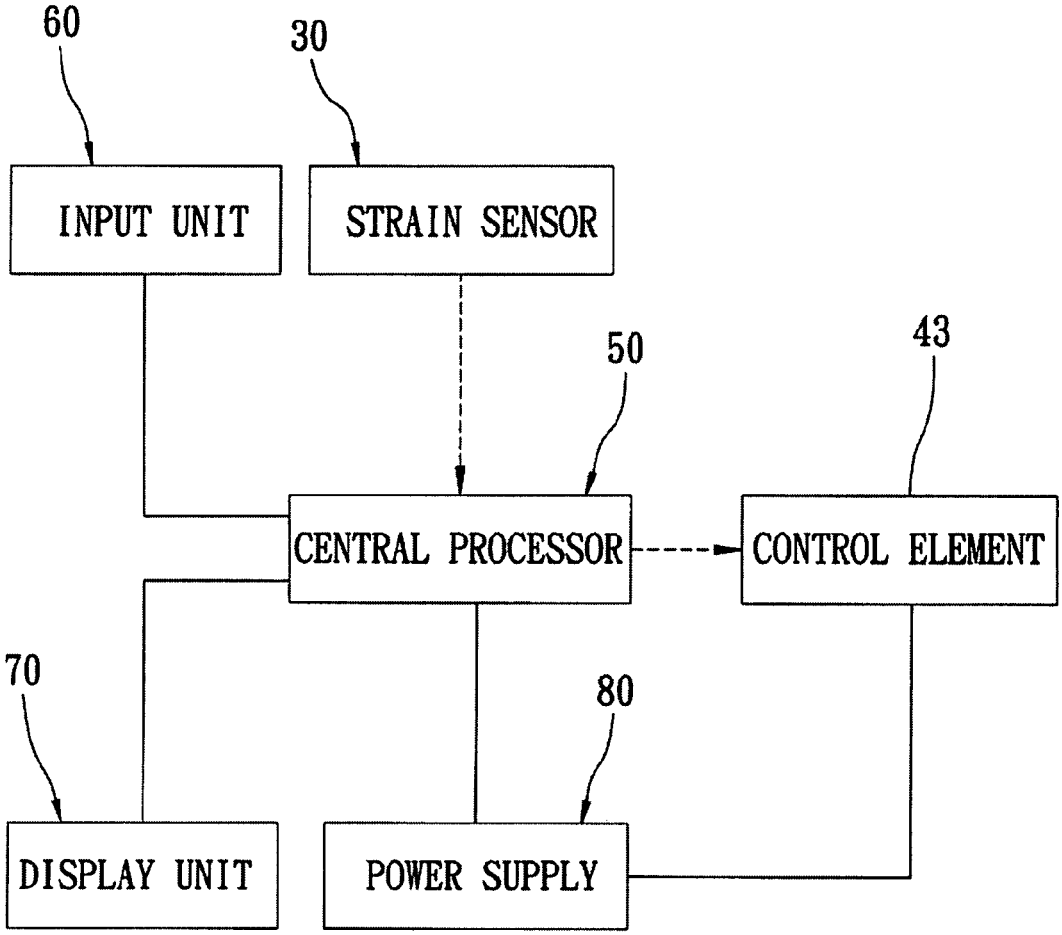
FIG. 2 is a block diagram of the first preferred embodiment.
Figure 3:
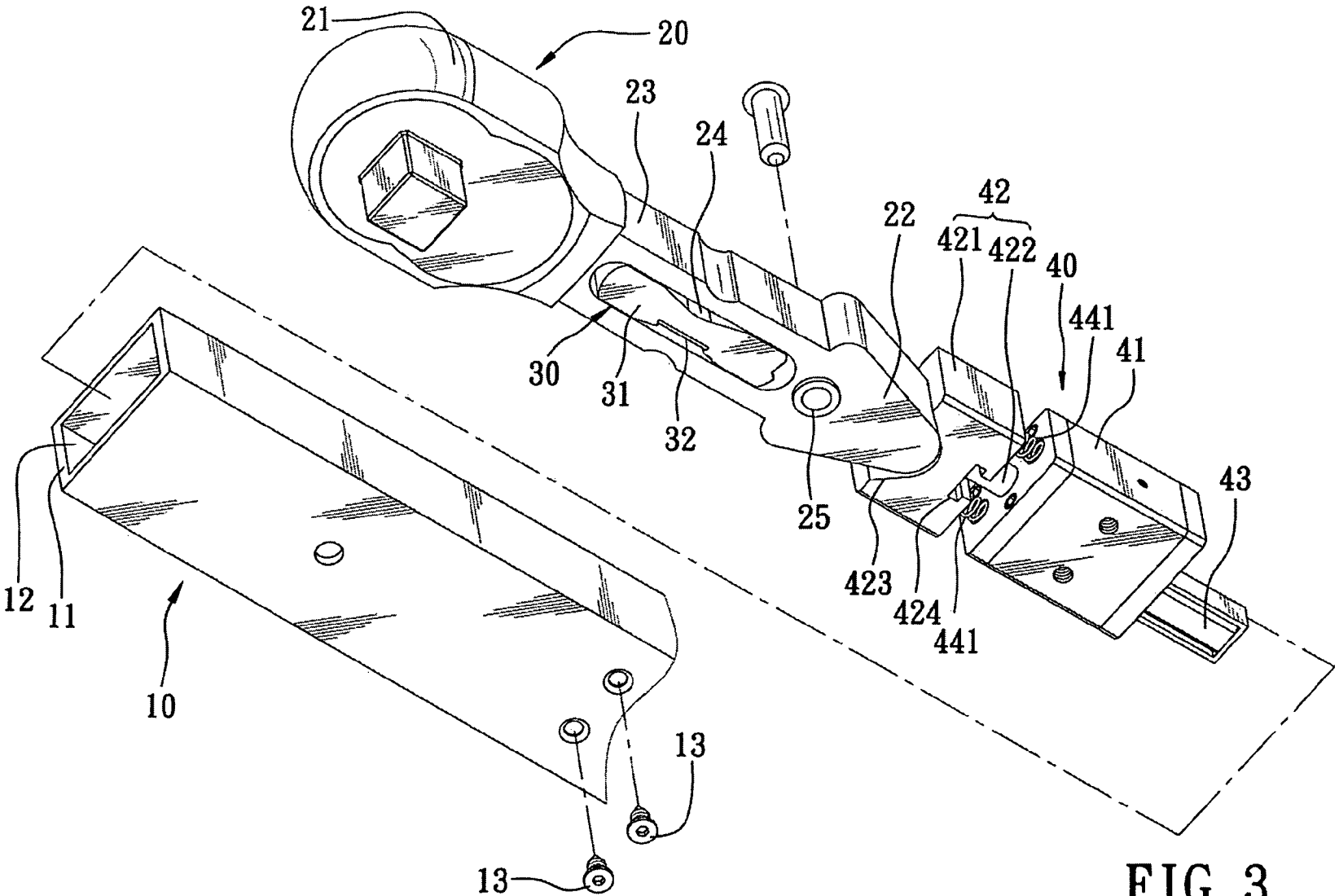
FIG. 3 is a fragmentary exploded perspective view of the first preferred embodiment.

With reference to FIGS. 1 and 2, when a torque is applied to a workpiece, such as a bolt (not shown) or the like, through the drive head 21 of the working unit 20 which is fitted to a socket (not shown), the central processor 50 determines whether or not the measured torque value of the strain sensor 30 has exceeded the preset reference torque value. When the measured torque value is smaller than the preset reference torque value, the central processor 50 controls a forward sliding movement of the valve rod 431 so as to prevent flow of the hydraulic fluid 415 from the first chamber section 412 to the valve channel 414 and then to the second chamber section 413, so that the hydraulic fluid 415 is pressurized in the first chamber section 412 and pushes the plunger 422 to press the concaved contact face 423 of the seat portion 421 against the rear end of the abutment portion 22 until the abutment portion 22 is seated on the center of the concaved contact face 423, i.e., the center of the seat portion 421. In this state, the working unit 20 is aligned with the X-axis, and the piston 442 is biased by the second spring member 443 to force the hydraulic fluid 415 toward the valve channel 414 from the second chamber section 413.

Figure 4:
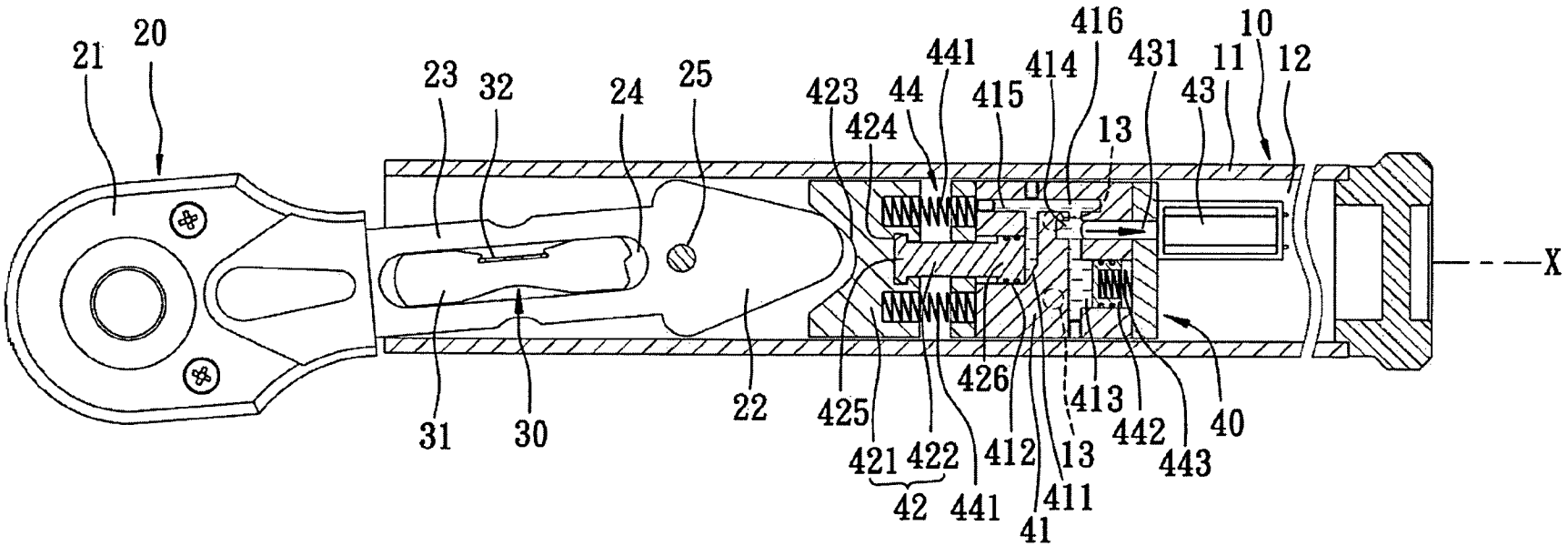
FIG. 4 is a view similar to FIG. 1, but illustrating an abutment portion of a working unit moving away from a center of a seat portion of a trip element.

With reference to FIGS. 2 and 4, when the central processor 50 determines that the measured torque value of the strain sensor 30 has exceeded the preset reference torque value, the central processor 50 control sa rearward sliding movement of the valve rod 431 so as to permit flow of the hydraulic fluid 415 from the first chamber section 412 to the valve channel 414 and then to the second chamber section 413, thereby depressurizing the hydraulic fluid 415 in the first chamber section 412. Since the hydraulic fluid 415 is depressurized, the rear end of the abutment portion 22 is permitted to move away from the center of the concaved contact face 423 of the seat portion 421 and simultaneously push the trip element 42 toward the cylinder 41. Hence, the working unit 20 is permitted to displace and swing relative to the tubular housing 10 so as to impact the surrounding wall 11 of the tubular housing 10. At this time, the first spring members 441 are compressed by the trip element 42, and the hydraulic fluid 415 in the first chamber section 412 is forced by the rear end portion 426 of the plunger 422 to flow from the first chamber section 412 to the valve channel 414 and then to the second chamber section 413, thereby pushing the piston 442 to compress the second spring member 443.

When no force is exerted on the drive head 21, through the restoring action of the first spring members 441, the seat portion 421 of the trip element 42 is restored to abut against the abutment portion 22 of the working unit 20. During this time, the restoring action of the second spring member 443 biases the piston 442 to force the hydraulic fluid 415 from the second chamber section 413 to the first chamber section 412 through the valve channel 414, and the central processor 50 controls the forward sliding movement of the valve rod 431 so as to prevent the hydraulic fluid 415 to flow from the first chamber section 412 through the valve channel 414 and to pressurize the hydraulic fluid 415 in the first chamber section 412. As such, the seat portion 421 can press against the abutment portion 22 until the working unit 20 is aligned with the X-axis (see FIG. 1) again.

From the aforementioned description, the advantages of the present invention can be summarized as follows:

1. The present invention not only can accurately set the preset reference torque value through an electronic control method, but also, by permitting the hydraulic fluid 415 to flow within the first and second chamber sections 412, 413, the working unit 20 can swing relative to the tubular housing 10 and impact the surrounding wall 11 thereof, thereby allowing the user to directly and clearly feel a tripping action of the wrench of the present invention. The user can then stop application of the torque.

2. The compression spring of the conventional mechanical torque wrench must produce a large biasing force to counteract an external force and to support the lever. The present invention uses the hydraulic fluid 415 to push the trip element 42 and to support the abutment portion 22 of the working unit 20, and controls the hydraulic fluid 415 through the operation of the valve rod 431. Hence, only a slight force is needed to control the valve rod 431 in order to counteract an external force.

Figure 5:
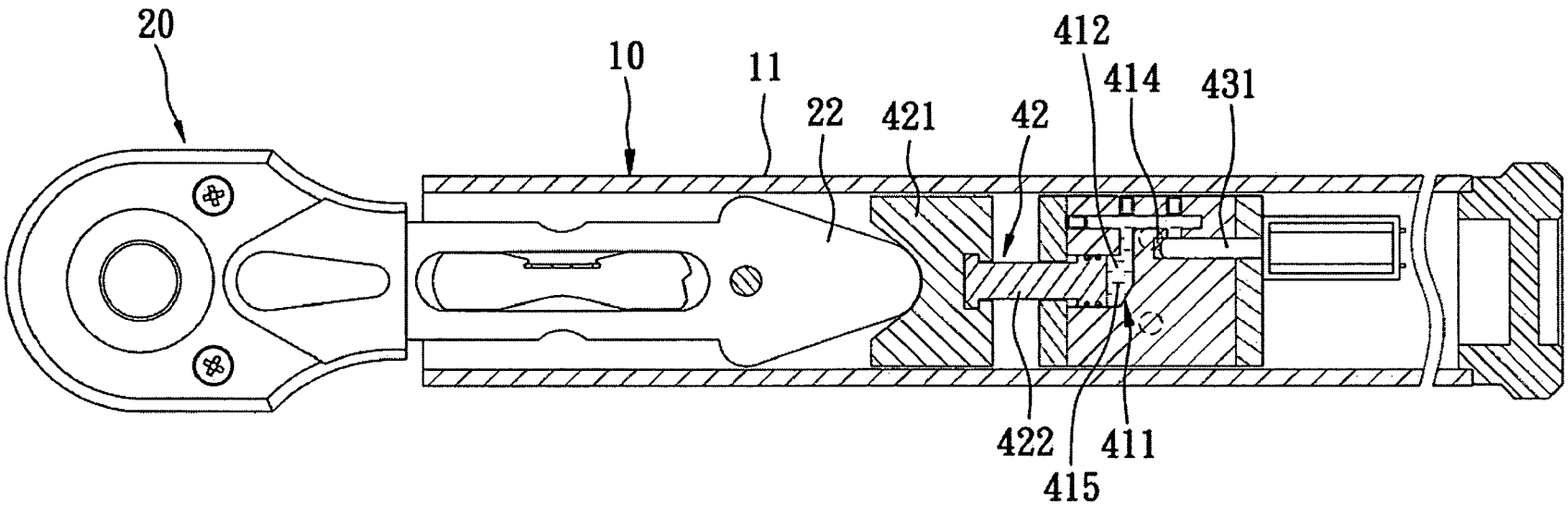
FIG. 5 is a fragmentary partly sectional view of an electronic torque wrench according to the second preferred embodiment of the present invention.
Figure 6:
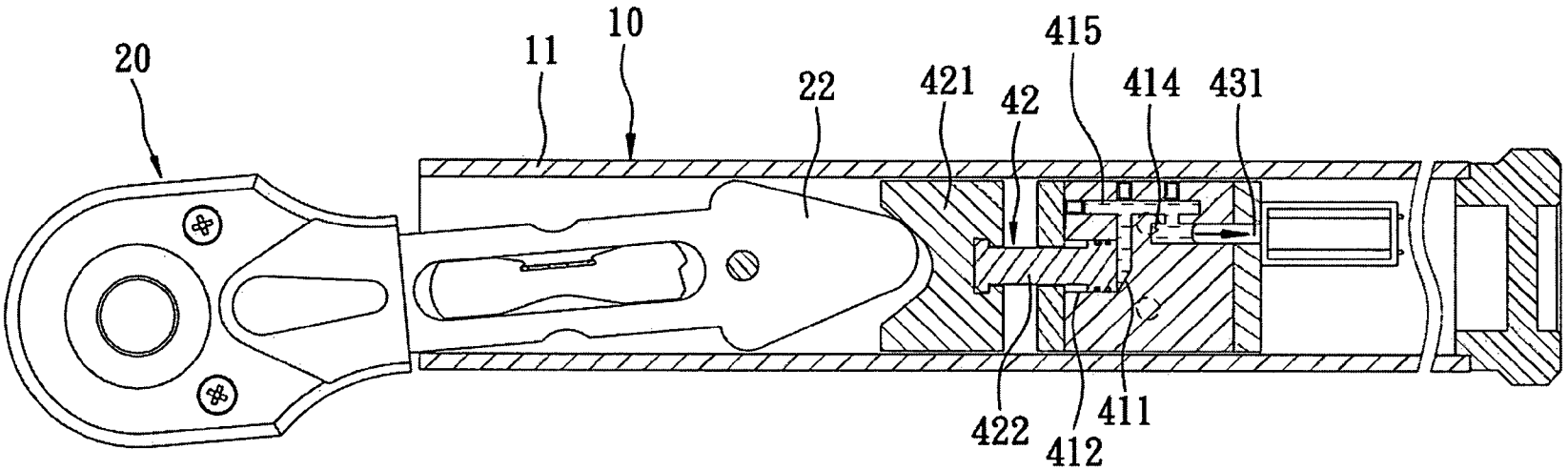
FIG. 6 is a view similar to FIG. 5, but illustrating an abutment portion of a working unit moving away from a center of a seat portion of a trip element.

Referring to FIGS. 5 and 6, an electronic torque wrench according to the second preferred embodiment of the present invention is shown to be similar to the first preferred embodiment. However, in this embodiment, the biasing mechanism 44 (see FIG. 1) is dispensed herewith since the valve rod 431 has a function of pressing fluid, and the second chamber section 413 (see FIG. 1) is omitted. Hence, when the valve rod 431 is controlled by the central processor 50 (see FIG. 2) to move forwardly in the valve channel 414, the hydraulic fluid 415 is similarly pressurized in the first chamber section 412 of the chamber 411 so as to push the plunger 422 to thereby cause the abutment portion 22 of the working unit 20 to be seated on the center of the seat portion 421 of the trip element 42. When the valve rod 431 is controlled to move rearwardly in the valve channel 414, the hydraulic fluid 415 is depressurized so as to permit the abutment portion 22 to move away from the center of the seat portion 421 of the trip element 42, and the working unit 20 is permitted to swing so as to impact the surrounding wall 11 of the tubular housing 10. Therefore, the advantages and effects of the first preferred embodiment can be similarly achieved using the second preferred embodiment.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. An electronic torque wrench, comprising:

a tubular housing having a receiving space;

a working unit connected pivotally to said tubular housing, and having a drive head extending outwardly of said tubular housing, and an abutment portion extending into said receiving space;

a strain sensor provided in said working unit;

a trip unit disposed in said receiving space, and including a cylinder fixed to said tubular housing and having a chamber containing hydraulic fluid, a trip element disposed movably between said abutment portion and said cylinder, and a control element connected to said cylinder, said trip element having a seat portion to seat said abutment portion, and a plunger extending into said chamber, said control element pressurizing said hydraulic fluid so as to push said plunger to thereby cause said abutment portion to be seated on a center of said seat portion of said trip element, or depressurizing said hydraulic fluid so as to permit said abutment portion to move away from the center of said seat portion; and a central processor provided on said tubular housing and connected electrically to said strain sensor and said control element, said central processor controlling said control element to depressurize said hydraulic fluid when an applied torque measured by said strain sensor is larger than a preset reference torque value.

2. The electronic torque mechanism of claim 1, wherein said trip element further has a biasing mechanism for biasing said trip element toward said abutment portion.

3. The electronic torque mechanism of claim 2, wherein said biasing mechanism has two first spring members disposed between said trip element and said cylinder.

4. The electronic torque mechanism of claim 1, wherein said chamber has a first chamber section receiving a portion of said plunger to be pushed by said hydraulic fluid, and a valve channel connected fluidly to said first chamber section, said control element having a valve rod that is disposed slidably in said valve channel to prevent said hydraulic fluid to flow into said valve channel from said first chamber section so as to pressurize said hydraulic fluid in said first chamber section, or to permit said hydraulic fluid to flow into said valve channel from said first chamber section so as to depressurize said hydraulic fluid in said first chamber section.

5. The electronic torque mechanism of claim 4, wherein said chamber further has a second chamber section connected fluidly to said valve channel.

6. The electronic torque mechanism of claim 5, wherein said trip unit further has a piston disposed movably in said second chamber section, and a second spring member biasing said piston to force said hydraulic fluid from said second chamber section to said valve channel.

7. The electronic torque mechanism of claim 1, wherein said seat portion of said trip element has a concaved contact face to contact said abutment portion of said working unit.

8. The electronic torque mechanism of claim 7, wherein said seat portion of said trip element further has an engaging groove opposite to said concaved contact face, said plunger having a front end portion engaged to said engaging groove, and a rear end portion extending into said chamber of said cylinder.

9. The electronic torque mechanism of claim 1, wherein said working unit further has a neck portion connected between said drive head and said abutment portion, and a slot formed in said neck portion, said strain sensor having a strain body disposed in said slot, and a strain gauge installed on said strain body.

* * * * *